US011845905B2

(12) United States Patent
Doyen et al.

(10) Patent No.: US 11,845,905 B2
(45) Date of Patent: Dec. 19, 2023

(54) LUBRICANT FOR A MARINE ENGINE

(71) Applicant: TOTALENERGIES ONETECH, Courbevoie (FR)

(72) Inventors: Valérie Doyen, Solaize (FR); Modestino De Feo, Solaize (FR); Gregory Chao, Solaize (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 17/775,393

(22) PCT Filed: Nov. 5, 2020

(86) PCT No.: PCT/EP2020/081072
§ 371 (c)(1),
(2) Date: May 9, 2022

(87) PCT Pub. No.: WO2021/089676
PCT Pub. Date: May 14, 2021

(65) Prior Publication Data

US 2022/0396747 A1 Dec. 15, 2022

(30) Foreign Application Priority Data

Nov. 7, 2019 (EP) ..... 19315134

(51) Int. Cl.

| | |
|---|---|
| ***C10M 133/04*** | (2006.01) |
| ***C10M 105/60*** | (2006.01) |
| ***C10M 169/04*** | (2006.01) |
| *C10N 30/00* | (2006.01) |
| *C10N 40/25* | (2006.01) |
| *C10N 30/02* | (2006.01) |
| *C10N 30/04* | (2006.01) |

(52) U.S. Cl.
CPC ..... *C10M 105/60* (2013.01); *C10M 169/045* (2013.01); *C10M 2207/028* (2013.01); *C10M 2207/26* (2013.01); *C10M 2215/04* (2013.01); *C10N 2030/02* (2013.01); *C10N 2030/04* (2013.01); *C10N 2030/52* (2020.05); *C10N 2040/252* (2020.05)

(58) Field of Classification Search
CPC ..... C10M 2215/04; C10M 133/04; C10M 105/60; C10M 169/045; C10M 2207/028; C10M 2207/26; C10M 163/00; C10N 2030/02; C10N 2030/04; C10N 2030/52; C10N 2040/252
USPC ..... 508/558
See application file for complete search history.

(56) References Cited

U.S. PATENT DOCUMENTS

| | | | | |
|---|---|---|---|---|
| 3,114,702 | A * | 12/1963 | Thompson | C10M 1/08 208/348 |
| 3,324,182 | A * | 6/1967 | Blake | C10M 3/00 564/481 |
| 4,089,792 | A * | 5/1978 | Lowe | C10M 1/08 508/262 |
| 2007/0214713 | A1* | 9/2007 | Karl | C10M 133/56 44/432 |
| 2011/0092403 | A1 | 4/2011 | Lancon et al. | |
| 2016/0177216 | A1 | 6/2016 | Lancon et al. | |
| 2016/0251590 | A1* | 9/2016 | Lundgren | C10M 133/06 508/556 |
| 2017/0313955 | A1* | 11/2017 | Doyen | C10M 133/06 |
| 2022/0389346 | A1* | 12/2022 | Doyen | C07C 211/14 |

FOREIGN PATENT DOCUMENTS

| | | |
|---|---|---|
| CA | 2 840 524 A1 | 1/2013 |
| EP | 2 540 808 A1 | 1/2013 |

OTHER PUBLICATIONS

Dec. 23, 2020 International Search Report issued in International Patent Application No. PCT/EP2020/081072.
May 10, 2022 International Preliminary Report on Patentability issued in International Patent Application No. PCT/EP2020/081072.

* cited by examiner

*Primary Examiner* — Ellen M McAvoy
(74) *Attorney, Agent, or Firm* — Oliff PLC

(57) ABSTRACT

A lubricant for marine engine, notably for a two-stroke marine engine. More particularly, a lubricant for a marine engine including at least one lubricant base oil and at least one di-alkylaminopolyalkylamine.

16 Claims, No Drawings

LUBRICANT FOR A MARINE ENGINE

The present invention relates to the field of lubricants, more particularly it relates to lubricants for marine engines, notably for a two-stroke marine engine and a four-stroke marine engine, preferably for a two-stroke marine engine. More particularly, the present invention relates to a lubricant for a marine engine comprising at least one lubricant base oil and at least one di-alkylamino poly(alkylamine), and more particularly dimethylaminopropylaminopropylamine (DMAPAPA).

STATE OF THE ART

The lubricant according to the invention has an important neutralization capacity characterized by a low or a high BN or Base Number and it can be used both with high-sulphur fuel oils and low-sulphur fuel oils.

The lubricant according to the invention has an improved neutralization capacity towards sulfuric or sulfurous acid formed during the combustion of high-sulphur fuel oils.

The lubricant according to the invention has an improved neutralization capacity towards sulphuric or sulphurous acid formed during the combustion of low-sulphur fuel oils characterized by a low BN.

The present invention also concerns a method for lubricating a marine engine, and more particularly a two-stroke marine engine, comprising operating the engine with a lubricant according to the invention.

The marine oils used in low-speed two-stroke crosshead engines are of two types. On the one hand, cylinder oils ensuring the lubrication of the cylinder-piston assembly and, on the other hand, system oils ensuring the lubrication of all the moving parts apart from the cylinder-piston assembly. Within the cylinder-piston assembly, the combustion residues containing acid gases are in contact with the lubricating oil.

The acid gases are formed from the combustion of the fuel oils; these are in particular sulphur oxides ($SO_2$, $SO_3$), which are then hydrolyzed in contact with the moisture present in the combustion gases and/or in the oil. This hydrolysis generates sulphurous ($HSO_3$) and/or sulphuric ($H_2SO_4$) acids. To protect the surface of piston liners and avoid excessive corrosive wear, these acids must be neutralized, which is generally done by reaction with the basic sites included in the lubricant.

An oil's neutralization capacity is measured by its BN or Base Number, characterized by its basicity. It is measured according to standard ASTM D-2896 and is expressed as an equivalent in milligrams of potash per gram of oil (also called "mg of KOH/g" or "BN point"). The BN is a standard criterion making it possible to adjust the basicity of the cylinder oils to the sulphur content of the fuel oil used, in order to be able to neutralize all of the sulphur contained in the fuel, and capable of being converted to sulphuric and/or sulphurous acids by combustion and hydrolysis.

Thus, the higher the sulphur content of a fuel oil, the higher the BN of a marine oil needs to be. This is why marine oils with a BN varying from 5 to 140 mg KOH/g are found on the market. This basicity is provided by detergents that are overbased by insoluble metallic salts, in particular metallic carbonates. The detergents, mainly of anionic type, are for example metallic soaps of salicylate, phenate, sulphonate, carboxylate type etc. which form micelles where the particles of insoluble metallic salts are maintained in suspension. The usual overbased detergents intrinsically have a BN in a standard fashion comprised between 150 and 700 mg KOH per gram of detergent. Their percentage by mass in the lubricant is fixed as a function of the desired BN level.

Part of the BN can also be provided by non-overbased or "neutral" detergents with a BN typically less than 150. However, the production of marine engine cylinder lubricant formulas where the entire BN is provided by "neutral" detergents cannot be envisaged: it would in fact be necessary to incorporate them in excessive quantities, which could be detrimental to other properties of the lubricant and would not be realistic from an economic point of view.

The insoluble metallic salts of the overbased detergents, for example calcium carbonate, therefore contribute significantly to the BN of the usual lubricants. It can be considered that approximately at least 50%, typically 75%, of the BN of the cylinder lubricants is thus provided by these insoluble salts. The actual detergent part, or metallic soaps, found in both the neutral and overbased detergents, typically provides most of the remainder of the BN.

Currently, in the presence of fuel oils with a high sulphur content (3.5% m/m and more), marine lubricants having a BN from 70 to 140 are used. In the presence of fuel oils with a low sulphur content (1.5% m/m and less), marine lubricants having a BN from 10 to 70 are used. In these two cases, a sufficient neutralizing capacity is achieved as the necessary concentration in basic sites provided by the overbased detergents of the marine lubricant is reached.

Application WO 2017/148816 discloses a lubricant composition comprising at least one lubricant base oil and at least a di-fatty-alkyl(ene) polyalkylamine composition comprising branched compounds.

Application WO 2016/066517 discloses a lubricant composition for marine engines, comprising at least one lubricant base oil, at least one di-fatty-alkyl polyalkylamine having a BN determined according to standard ASTM D-2896 ranging from 150 to 350 milligrams of potassium hydroxide per gram of amine, and at least one additive chosen from overbased detergents and/or neutral detergents Application WO 2009/153453 discloses cylinder lubricants for two-stroke marine engines which can be used with both high-sulphur fuel oils and low-sulphur fuel oils, comprising: one or more lubricating base oils, at least one detergent based on alkali or alkaline-earth metals, overbased by metal carbonate salts, in possible combination with one or more neutral detergents, one or more fatty amines and/or derivatives of fatty amines that are soluble in the oil, said amines having a BN determined according to the standard ASTM D-2896 between 150 and 600 milligrams of potassium hydroxide per gram, preferably between 200 and 500 milligrams of potassium hydroxide per gram, having preferably a fatty alkyl chain of from 12 to 24 carbon atoms.

Application WO 2011/042552 discloses lubricants for marine engines comprising: a base oil, at least one detergent and an amine compound which is an alkyl monoamine compound, most preferably a C12-C18 alkylamine compound.

U.S. Pat. No. 3,814,212 discloses the use of a mono- or a polyamine containing at least 12 carbon atoms as a lubricant in the working of non-ferrous metals.

Document U.S. Pat. No. 4,205,045 discloses a composition having a major portion of a lubricating oil and at least an amine or amine derivative of a hydrocarbon-soluble polymerized fatty acid, like for example a dimeramine derived from a dicarboxylic acid containing at least 12 carbon atoms. Such a composition has improved antifriction and fuel economy properties.

Document WO 2014/180843 discloses a lubricant for a marine engine comprising at least one base oil, at least one overbased detergent, and at least one neutral detergent and at least one fatty amine.

None of the prior art documents discloses the amines of formula (I) according to the invention and their use in a lubricating oil composition for improving the efficiency of the lubricant, notably for improving the neutralization kinetic towards sulphuric and/or sulphurous acid formed during the combustion of high-sulphur fuel oils and also low-sulphur fuel oils.

Consequently, there exists a specific and important requirement in developing a new marine lubricant having either a high BN, i.e. from 70 to 140, or a low BN, i.e. from 10 to 70, in which the content of the amine can be used in smaller amounts compared to prior art amine compounds, especially in order to reduce the costs of production of the formulation, whilst the kinetic of neutralization of the sulphuric or sulphurous acid created during the combustion of the fuel is improved.

An object of the present invention is to provide a method for lubricating a marine engine, and especially for a two-stroke marine engine which can be used both with low-sulphur fuel oils and with high-sulphur fuel oils.

Another object of the present invention is to provide a lubricant composition whose formulation is easy to implement.

SUMMARY OF THE INVENTION

The invention is directed to a lubricant composition comprising:

at least one lubricant base oil, at least one di-alkylaminopolyalkylamine responding to formula (I):

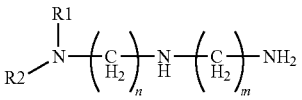

(I)

wherein,

R1, R2 represent, independently, an alkyl moiety with 1 to 3 carbon atoms, which is linear or branched, n and m are integers representing, independent of each other, either 1, 2, or 3, and the total number of carbon atoms in (I) is from 4 to 10.

According to a favourite variant, in formula (I), R1=R2=$CH_3$.

According to a favourite variant, the di-alkylaminopolyalkylamine (I) responds to formula (IA):

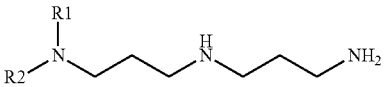

(IA)

wherein R1, R2 represent, independently, an alkyl moiety with 1 or 2 carbon atoms.

According to a more favourite variant, the di-alkylaminopolyalkylamine responding to formula (I) is dimethylaminopropylaminopropylamine (DMAPAPA):

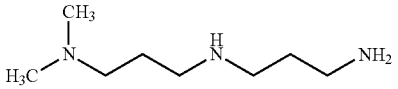

According to a favourite embodiment, the percentage by weight of di-alkylaminopolyalkylamine of formula (I), particularly DMAPAPA, relative to the total weight of lubricant composition is chosen such that the BN provided by the di-alkylaminopolyalkylamine of formula (I) represents a contribution of at least 0.1 milligrams of potash per gram of lubricant, relative to the total BN of said lubricant.

According to another favourite embodiment, the percentage by weight of di-alkylaminopolyalkylamine of formula (I), particularly DMAPAPA, relative to the total weight of the lubricant composition ranges from 0.05 to 10%.

Preferably, in a first aspect, the lubricant composition according to the invention comprises:

from 90.00 to 99.95% of at least one base oil, from 0.05 to 10.00% of at least one di-alkylaminopolyalkylamine of formula (I), particularly DMAPAPA, the percentages being defined by weight of component as compared to the total weight of the composition.

In a second aspect, the lubricant composition according to the invention further comprises at least one detergent (Det) selected from neutral and overbased detergents having a Total Base Number according to ASTM D2896 of from 20 to 500 mg KOH/g.

According to a favourite embodiment, the lubricant composition comprises from 1 to 35% by weight of neutral and overbased detergents, with regards to the total weight of the lubricant composition.

Preferably, according to the second aspect, the lubricant composition comprises:

from 60.0 to 98.5% of at least one base oil, from 0.5 to 5.0% of at least one amine of formula (I), preferably DMAPAPA, from 1.0 to 35.0% of at least one detergent selected from neutral and overbased detergents having a Total Base Number according to ASTM D2896 of from 20 to 500 mg KOH/g the percentages being defined by weight of component as compared to the total weight of the composition.

Suitably, the lubricant composition according to the invention has a Total Base Number (TBN) value according to ASTM D2896 of above 10 mg KOH/g.

Preferably, the lubricant composition according to the invention has a kinematic viscosity at 100° C. superior or equal to 5.6 $mm^2/s$ and inferior or equal to 26.1 $mm^2/s$.

The invention is also directed to the use of the above-described lubricant composition for improving the kinematic neutralization of sulphuric acid and/or sulphurous acid in the hot section of a marine engine, notably of a two-stroke marine engine.

The invention is also directed to a method for lubricating a marine engine, and more particularly a two-stroke marine engine, comprising operating the engine with a lubricant composition according to the invention.

Surprisingly, it has been found that a special selection of dialkylaminopolyalkylamines of formula (I), particularly dimethylaminopropylaminopropylamine (DMAPAPA), when used in a lubricant composition comprising a base oil and an overbased detergent, provide the following advantages, compared to the prior art compositions based on prior art amine compounds:

The amine can be used in smaller amounts compared to prior art amine compounds and thus offers an ability in reducing the costs of production of the formulation.

The content of the overbased detergent can be reduced, while increasing the neutralization capacity of the composition.

The kinetic of neutralization of the sulphuric acid and/or the sulphurous acid created during the combustion of the fuel is increased.

DETAILED DESCRIPTION

The term "consists essentially of" followed by one or more characteristics, means that may be included in the process or the material of the invention, besides explicitly listed components or steps, components or steps that do not materially affect the properties and characteristics of the invention.

The expression "comprised between X and Y" includes boundaries, unless explicitly stated otherwise. This expression means that the target range includes the X and Y values, and all values from X to Y.

Throughout the description and claims of this specification, the words "comprise" and "contain" and variations of the words, for example "comprising" and "comprises", mean "including but not limited to", and do not exclude other moieties, additives, components, integers or steps. Moreover, the singular encompasses the plural unless the context otherwise requires: in particular, where the indefinite article is used, the specification is to be understood as contemplating plurality as well as singularity, unless the context requires otherwise.

Where upper and lower limits are quoted for a property, for example for the concentration of a component, then a range of values defined by a combination of any of the upper limits with any of the lower limits may also be implied.

The di-alkylaminopolyalkylamines

The present invention concerns a lubricant composition comprising:

at least one lubricant base oil, and at least one di-alkylaminopolyalkylamine responding to formula (I):

(I)

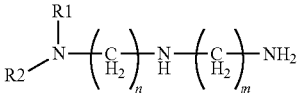

wherein,

R1, R2 represent, independently, an alkyl moiety with 1 to 3 carbon atoms, which is linear or branched, n and m are integers representing, independent of each other, either 1, 2, or 3, and the total number of carbon atoms in formula (I) is from 4 to 10.

According to a favourite embodiment, the total number of carbon atoms in formula (I) is from 6 to 10.

According to a favourite embodiment, in formula (I) the total number of carbon atoms in formula (I) is 8.

According to a favourite embodiment, in formula (I), R1=R2.

According to a favourite embodiment, in formula (I), R1=R2=$CH_3$.

According to a favourite embodiment, in formula (I), n=m.

According to a favourite embodiment, in formula (I), n=m=3. According to this embodiment, compound (I) responds to formula (IA):

(IA)

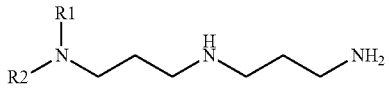

wherein R1, R2 represent, independently, an alkyl moiety with 1 or 2 carbon atoms.

According to a favourite embodiment, in formula (IA), R1=R2.

According to a favourite embodiment, in formula (IA), R1=R2=$CH_3$.

According to a more favourite embodiment, the di-alkylaminopolyalkylamine responding to formula (I) is dimethylaminopropylaminopropylamine (DMAPAPA):

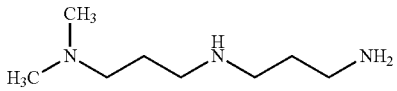

The Applicant has found that a significant part of the BN provided by the amines of formula (I), particularly DMAPAPA, allows maintaining the same level of performance for a marine lubricant compared to conventional formulations of equivalent or higher BN.

Accordingly, the present invention makes it possible to formulate lubricant compositions with high BN for a marine engine, in particular for a four-stroke marine engine and a two-stroke marine engine, preferably for a two-stroke marine engine, that can be operated with both high sulphur fuel oils and low sulphur fuel oils, while maintaining the other performances of the lubricating composition at a satisfactory level.

Alternatively, the present invention makes it possible to formulate lubricant compositions with low BN for a marine engine in particular for a four-stroke marine engine and a two-stroke marine engine, that can be operated with low sulphur fuel oils, while maintaining the other performances of the lubricating composition at a satisfactory level.

Further, the lubricant compositions according to the invention have an efficient neutralization capacity of sulphurous acid ($HSO_3$).

Further, the lubricant compositions according to the invention have an efficient neutralization capacity of sulphuric acid ($H_2SO_4$).

Particularly, lubricant compositions comprising the amines according to the invention, notably DMAPAPA, have improved kinetics of neutralization of sulphurous and/or sulphuric acids. Said improved kinetics of neutralization can be observed by performing the test described below.

The Applicant has found that the amines of formula (I), particularly DMAPAPA, have a higher BN than prior art amines and thus can provide the same part of the TBN of the lubricant composition with a smaller weight amount of amine.

The percentage by weight of amines of formula (I), particularly DMAPAPA, relative to the total weight of lubricant composition is chosen such that the BN provided by these compounds represents a contribution of at least 0.1 milligrams of potash per gram of lubricant, preferably at least 1 milligram of potash per gram, relative to the total BN of said lubricant.

In a preferred embodiment of the invention, the weight percentage of amines of formula (I), particularly DMAPAPA, relative to the total weight of the lubricant composition ranges from 0.05 to 10%, preferably from 0.1 to 8%, advantageously from 0.5 to 5%.

Lubricant Composition

The invention is also directed to the use of the amines of formula (I), particularly DMAPAPA, that have been disclosed above, as additives in lubricating oil (or lubricant) compositions.

The invention is further directed to some lubricant compositions for two stroke and four stroke marine engines comprising such additives.

According to a first favourite embodiment, the lubricant composition comprises, advantageously consists essentially of:

from 90.00 to 99.95% of at least one base oil, from 0.05 to 10.00% of at least one amine of formula (I), preferably DMAPAPA, the percentages being defined by weight of component as compared to the total weight of the composition.

Advantageously, according to this embodiment, the lubricant composition comprises, advantageously consisting essentially of:

from 92.0 to 99.9% of at least one base oil, from 0.1 to 8.0% of at least one amine of formula (I), preferably DMAPAPA, the percentages being defined by weight of component as compared to the total weight of the composition.

According to another favourite embodiment, the invention is directed to a lubricant composition comprising, advantageously consisting essentially of:

at least one base oil, at least one amine of formula (I), preferably DMAPAPA, at least one detergent selected from neutral and overbased detergents having a Total Base Number according to ASTM D2896 of from 20 to 500 mg KOH/g.

Advantageously, according to this embodiment, the lubricant composition comprises, advantageously consists essentially of:

from 60.0 to 98.5% of at least one base oil, from 0.5 to 5.0% of at least one amine of formula (I), preferably DMAPAPA, from 1.0 to 35.0% of at least one detergent selected from neutral and overbased detergents having a Total Base Number according to ASTM D2896 of from 20 to 500 mg KOH/g, the percentages being defined by weight of component as compared to the total weight of the composition.

More advantageously, the lubricant composition comprises, advantageously consists essentially of:

from 61.5 to 94.0% of at least one base oil, from 1.0 to 3.5% of at least one amine of formula (I), preferably DMAPAPA, from 5.0 to 35.0% at least one detergent selected from neutral and overbased detergents having a Total Base Number according to ASTM D2896 of from 20 to 500 mg KOH/g, the percentages being defined by weight of component as compared to the total weight of the composition.

Base Oils

Generally, the lubricating oil compositions according to the invention comprise as a first component an oil of lubricating viscosity, also called "base oils". The base oil for use herein can be any presently known or later-discovered oil of lubricating viscosity used in formulating lubricating oil compositions for any of the following applications, e.g., engine oils, marine cylinder oils, functional fluids such as hydraulic oils, gear oils, transmission fluids, like for example automatic transmission fluids, turbine lubricants, trunk piston engine oils, compressor lubricants, metal-working lubricants, and other lubricating oil and grease compositions.

Advantageously, the lubricant compositions according to the invention are marine engine lubricating oil compositions, like two-stroke marine engine lubricating oil compositions and four-stroke marine engine lubricating oil compositions, preferably they are two-stroke marine engine lubricating oil compositions.

Generally, the oils also called "base oils" used for formulating lubricant compositions according to the present invention may be oils of mineral, synthetic or plant origin as well as their mixtures. The mineral or synthetic oils generally used in the application belong to one of the classes defined in the API classification as summarized below:

| | Saturated substance content (weight percent) | Sulphur content (weight percent) | Viscosity Index |
|---|---|---|---|
| Group 1 Mineral oils | <90% | >0.03% | 80 ≤ VI < 120 |
| Group 2 Hydro-cracked oils | ≥90% | ≤0.03% | 80 ≤ VI < 120 |
| Group 3 Hydro-isomerized oils | ≥90% | ≤0.03% | ≥120 |
| Group 4 | PAOs | | |
| Group 5 | Other bases not included in the base Groups 1 to 4 | | |

These mineral oils of Group 1 may be obtained by distillation of selected naphthenic or paraffinic crude oils followed by purification of these distillates by methods such as solvent extraction, solvent or catalytic dewaxing, hydrotreating or hydrogenation.

The oils of Groups 2 and 3 are obtained by more severe purification methods, for example a combination of hydrotreating, hydrocracking, hydrogenation and catalytic dewaxing. Examples of synthetic bases of Groups 4 and 5 include poly-alpha olefins, polybutenes, polyisobutenes, alkylbenzenes.

These base oils may be used alone or as a mixture. A mineral oil may be combined with a synthetic oil.

The lubricant compositions of the invention have a viscosity grade of SAE-20, SAE-30, SAE-40, SAE-50 or SAE-60 according to the SAEJ300 classification.

Grade 20 oils have a kinematic viscosity at 100° C. of between 5.6 and 9.3 $mm^2/s$.

Grade 30 oils have a kinematic viscosity at 100° C. of between 9.3 and 12.5 $mm^2/s$.

Grade 40 oils have a kinematic viscosity at 100° C. of between 12.5 and 16.3 $mm^2/s$.

Grade 50 oils have a kinematic viscosity at 100° C. of between 16.3 and 21.9 $mm^2/s$.

Grade 60 oils have a kinematic viscosity at 100° C. of between 21.9 and 26.1 $mm^2/s$.

Advantageously, the quantity of base oil in the lubricant composition of the invention is from 60% to 99.95% by weight relative to the total weight of the lubricant composition, preferably from 60% to 99.9%, more preferably from 60.5% to 94%.

Detergents

Amines of formula (I) as defined above, advantageously DMAPAPA, play the role of detergent in the lubricant composition. They have the advantage of permitting the use of lower amounts of metal detergents. Therefore, the amines of formula (I) as defined above, advantageously DMAPAPA, give access to compositions which have the capacity to neutralize sulphurous or sulphuric acids from low-sulphur fuel compositions and high-sulphur fuel compositions. According to the invention, amines of formula (I) as defined above, advantageously DMAPAPA, are preferentially used in combination with at least one detergent that does not belong to the class of amines (I), preferably at least one metal detergent.

Detergents, other than the amines of formula (I), are typically anionic compounds containing a long lipophilic hydrocarbon chain and a hydrophilic head, wherein the associated cation is typically a metal cation of an alkali metal or alkaline earth metal. The detergents are preferably selected from alkali metal salts or alkaline earth metal (particularly preferably calcium, magnesium, sodium or barium) salts of carboxylic acids, sulphonates, salicylates, naphthenates, as well as the salts of phenates. These metal salts may contain the metal in an approximately stoichiometric amount relative to the anion group(s) of the detergent. In this case, one refers to non-overbased or "neutral" detergents, although they also contribute to a certain basicity. These "neutral" detergents typically have a BN measured according to ASTM D2896, of less than 150 mg KOH/g, or less than 100 mg KOH/g, or less than 80 mg KOH/g of detergent. This type of so-called neutral detergent may contribute in part to the BN of lubricating compositions. For example, neutral detergents are used such as carboxylates, sulphonates, salicylates, phenates, naphthenates of the alkali and alkaline earth metals, for example calcium, sodium, magnesium, barium. When the metal is in excess (amount greater than the stoichiometric amount relative to the anion groups(s) of the detergent), then these are so-called overbased detergents. Their BN is high, higher than 150 mg KOH/g of detergent, typically from 200 to 700 mg KOH/g of detergent, preferably from 250 to 500 mg KOH/g of detergent. The metal in excess providing the character of an overbased detergent is in the form of insoluble metal salts in oil, for example carbonate, hydroxide, oxalate, acetate, glutamate, preferably carbonate. In one overbased detergent, the metals of these insoluble salts may be the same as, or different from, those of the oil soluble detergents. They are preferably selected from calcium, magnesium, sodium or barium. The overbased detergents are thus in the form of micelles composed of insoluble metal salts that are maintained in suspension in the lubricating composition by the detergents in the form of soluble metal salts in the oil. These micelles may contain one or more types of insoluble metal salts, stabilised by one or more types of detergent. The overbased detergents comprising a single type of detergent-soluble metal salt are generally named according to the nature of the hydrophobic chain of the latter detergent. Thus, they will be called a phenate, salicylate, sulphonate, naphthenate type when the detergent is respectively a phenate, salicylate, sulphonate or naphthenate. The overbased detergents are called mixed type if the micelles comprise several types of detergents, which are different from one another by the nature of their hydrophobic chain. The overbased detergent and the neutral detergent may be selected from carboxylates, sulphonates, salicylates, naphthenates, phenates and mixed detergents combining at least two of these types of detergents. The overbased detergent and the neutral detergent include compounds based on metals selected from calcium, magnesium, sodium or barium, preferably calcium or magnesium. The overbased detergent may be overbased by metal insoluble salts selected from the group of carbonates of alkali and alkaline earth metals, preferably calcium carbonate. The lubricating composition may comprise at least one overbased detergent and at least a neutral detergent as defined above.

Preferably, the composition according to the invention comprises from 1 to 35% weight neutral and overbased detergent, more advantageously from 5 to 35%, preferably from 8 to 35%, these percentages being by weight of neutral and overbased detergent, with regards to the total weight of the lubricant composition, preferably selected from neutral and overbased detergents having a Base Number according to ASTM D2896 of from 20 to 500 mg KOH/g.

Advantageously, the percentage by weight of neutral and overbased detergents relative to the total weight of lubricant is chosen such that the BN provided by the neutral and overbased detergents represents a contribution of at most 100 milligrams of potash per gram of lubricant, preferably from 5 to 60 milligrams of potash per gram of lubricant, to the total BN of said lubricant.

Additives:

It is optionally possible to substitute the above-described base oils in full or in part by one or more thickening additives whose role is to increase both the hot and cold viscosity of the composition, or by additives improving the viscosity index (VI).

The lubricant composition of the invention may comprise at least one optional additive, chosen in particular from among those frequently used by persons skilled in the art.

In one embodiment, the lubricant composition further comprises an optional additive chosen amongst an anti-wear additive, an oil soluble fatty amine, a polymer, a dispersing additive, an anti-foaming additive or a mixture thereof.

Polymers are typically polymers having a low molecular weight ($M_n$) of from 2 000 to 50 000 Dalton. The polymers are selected amongst PIB (of from 2 000 Dalton), polyacrylates or polymethacrylates (of from 30 000 Dalton), olefin copolymers, olefin and alpha-olefin copolymers, EPDM, polybutenes, poly alpha-olefin having a high molecular weight (viscosity 100° C.>150), hydrogenated or non-hydrogenated styrene-olefin copolymers.

Anti-wear additives protect the surfaces from friction by forming a protective film adsorbed on these surfaces. The most commonly used is zinc dithiophosphate or ZnDTP. Also in this category, there are various phosphorus, sulphur, nitrogen, chlorine and boron compounds. There are a wide variety of anti-wear additives, but the most widely used category is that of the sulphur phospho additives such as metal alkylthiophosphates, especially zinc alkylthiophosphates, more specifically, zinc dialkyl dithiophosphates or ZnDTP. The preferred compounds are those of the formula $Zn((SP(S)(OR_a)(OR_b))_2$, wherein $R_a$ and $R_b$ are alkyl groups, preferably having 1 to 18 carbon atoms. The ZnDTP is typically present at levels of about 0.1 to 2% by weight relative to the total weight of the lubricating composition. The amines, phosphates, polysulphides, including sulphurised olefins, are also widely used anti-wear additives. One also optionally finds nitrogen and sulphur type anti-wear and extreme pressure additives in lubricating compositions, such as, for example, metal dithiocarbamates, particularly molybdenum dithiocarbamate. Glycerol esters are also anti-wear additives. Mention may be made of mono-, di- and trioleates, monopalmitates and monomyristates. In one embodiment, the content of anti-wear additives ranges from 0.01 to 6%, preferably from 0.1 to 4% by weight relative to the total weight of the lubricating composition.

Dispersants are well known additives used in the formulation of lubricating compositions, in particular for application in the marine field. Their primary role is to maintain in suspension the particles that are initially present or appear in the lubricant during its use in the engine. They prevent their agglomeration by playing on steric hindrance. They may also have a synergistic effect on neutralisation. Dispersants used as lubricant additives typically contain a polar group, associated with a relatively long hydrocarbon chain, generally containing 50 to 400 carbon atoms. The polar group typically contains at least one nitrogen, oxygen, or phosphorus element. Compounds derived from succinic acid are particularly useful as dispersants in lubricating additives. Also used are, in particular, succinimides obtained by condensation of succinic anhydrides and amines, succinic esters obtained by condensation of succinic anhydrides and alcohols or polyols. These compounds can then be treated with various compounds including sulphur, oxygen, formaldehyde, carboxylic acids and boron-containing compounds or zinc in order to produce, for example, borated succinimides or zinc-blocked succinimides. Mannich bases, obtained by polycondensation of phenols substituted with alkyl groups, formaldehyde and primary or secondary amines, are also compounds that are used as dispersants in lubricants. In one embodiment of the invention, the dispersant content may be greater than or equal to 0.1%, preferably 0.5 to 2%, advantageously from 1 to 1.5% by weight relative to the total weight of the lubricating composition. It is possible to use a dispersant from the PIB succinimide family, e.g. boronated or zinc-blocked.

Other optional additives may be chosen from defoamers, for example, polar polymers such as polydimethylsiloxanes, polyacrylates. They may also be chosen from antioxidant and/or anti-rust additives, for example organometallic detergents or thiadiazoles. These additives are known to persons skilled in the art. These additives are generally present in a weight content of 0.1 to 5% based on the total weight of the lubricating composition.

The optional additives such as those defined above contained in the lubricant compositions of the present invention can be incorporated in the lubricant composition as separate additives, in particular through separate addition thereof in the base oils. However, they may also be integrated in a concentrate of additives for marine lubricant compositions.

Method for Producing a Lubricant Composition, Notably a Marine Lubricant Composition The present disclosure provides a method for producing a lubricant composition, especially a marine lubricant, as disclosed above, comprising the step of mixing the base oil with at least one amine of formula (I), preferably DMAPAPA, and optionally the detergents and the additives as disclosed above.

Properties of the Lubricant Composition

The components that have been disclosed above are formulated to provide a composition that advantageously has the following characteristics:

According to a first embodiment, the composition has a Total Base Number (TBN) value according to ASTM D2896 of greater than or equal to 70, preferably greater than or equal to 80, more preferably greater than or equal to 90 milligrams of potash per gram of lubricant.

Preferably, according to this embodiment, the lubricant composition according to the invention has a TBN, measured according to standard ASTM D-2896, comprised between 70 and 140, preferably between 70 and 120, advantageously between 90 and 110 milligrams of potash per gram of lubricant.

According to this first embodiment, the composition has a high BN (comprised between 70 and 140) and can be used for a marine engine, in particular for a four-stroke marine engine and a two-stroke marine engine, preferably for a two-stroke marine engine.

According to that first embodiment, in the lubricant composition according to the invention, the percentage by weight of di-alkylaminopolyalkylamine (I), preferably DMAPAPA, with respect to the total weight of lubricant, is chosen such that the BN provided by these compounds represents a contribution comprised between 0.5 and 60 milligrams of potash per gram of lubricant, preferably between 1.0 and 30 milligrams of potash per gram of lubricant of the TBN of said lubricant, determined according to the standard ASTM D-2896.

In said embodiment, the percentage by mass of di-alkylaminopolyalkylamine (I), preferably DMAPAPA, with respect to the total weight of lubricant composition is comprised between 0.05 and 10%, and preferably between 0.1 and 8%, more preferably between 0.5 and 3.5%.

According to a second embodiment, the lubricant composition according to the invention has a TBN, measured according to standard ASTM D-2896, of at most 70, and preferably of at most 30 milligrams of potash per gram of lubricant.

Preferably, according to this second embodiment, the lubricant composition according to the invention has a TBN, measured according to standard ASTM D-2896, comprised between 10 and 70, preferably between 15 and 30 milligrams of potash per gram of lubricant.

According to that second embodiment, and in a first variant, the lubricant composition according to the invention has a TBN, measured according to standard ASTM D-2896, comprised between 10 and 50 when used for a marine engine, in particular for a four-stroke marine engine and a two-stroke marine engine, preferably for a four-stroke marine engine.

According to that second embodiment, and in a second variant, the lubricant composition according to the invention has a TBN, measured according to standard ASTM D-2896, comprised between 20 and 70 when used for a marine engine, in particular for a four-stroke marine engine and a two-stroke marine engine, preferably for a two-stroke marine engine.

According to that second embodiment, in the lubricant composition according to the invention, the percentage by weight of di-alkylaminopolyalkylamine (I), preferably DMAPAPA, with respect to the total weight of lubricant, is chosen such that the BN provided by these compounds represents a contribution comprised between 0.5 and 40 milligrams of potash per gram of lubricant, preferably between 5.0 and 30 milligrams of potash per gram of lubricant of the TBN of said lubricant, determined according to the standard ASTM D-2896.

According to that second embodiment, in the lubricant composition according to the invention, the percentage by weight of di-alkylaminopolyalkylamine (I), preferably DMAPAPA, with respect to the total weight of lubricant composition, is comprised between 0.05 and 10%, and more preferably between 0.1 and 8%.

Preferably, the lubricant composition according to the invention has a kinematic viscosity at 100° C. superior or equal to 5.6 $mm^2/s$ and inferior or equal to 21.9 $mm^2/s$, preferably superior or equal to 12.5 $mm^2/s$ and inferior or equal to 21.9 $mm^2/s$, more preferably superior or equal to 14.3 $mm^2/s$ and inferior or equal to 21.9 $mm^2/s$, advantageously comprised between 16.3 and 21.9 $mm^2/s$, wherein kinematic viscosity at 100° C. is evaluated according to ASTM D 445.

Preferably, the lubricant composition according to the invention is a cylinder lubricant.

Advantageously, the lubricant composition is a cylinder lubricant for two-stroke diesel marine engines and has a viscosimetric grade SAE-40 to SAE-60 equivalent to a kinematic viscosity at 100° C. comprised between 16.3 and 21.9 $mm^2/s$.

Even more advantageously, the lubricating composition is a cylinder oil for two-stroke diesel marine engines and has a viscosimetric grade SAE-50, equivalent to a kinematic viscosity at 100° C. comprised between 16.3 and 21.9 $mm^2/s$.

Typically, a conventional formulation of cylinder lubricant for two-stroke marine diesel engines is of grade SAE 40 to SAE 60, preferentially SAE 50 (according to the SAE J300 classification) and comprises at least 50% by weight of a lubricating base oil of mineral and/or synthetic origin, adapted to the use in a marine engine, for example of the API Group 1 class or API Group 2 class.

These viscosities may be obtained by mixing additives and base oils, for example base oils containing mineral bases of Group 1 such as Neutral Solvent (for example 150 NS, 500 NS or 600 NS) bases and brightstock. Any other combination of mineral, synthetic bases or bases of plant origin, having, as a mixture with the additives, a viscosity compatible with the chosen SAE grade, may be used.

The Applicant found that it was possible to formulate cylinder lubricants in which a part of the TBN is provided by di-alkylaminopolyalkylamines, preferably DMAPAPA, whilst maintaining the level of performance compared with standard formulations with an equivalent TBN.

The performances in question here are in particular the capacity to neutralize sulphuric acid, measured using the enthalpy test described in the examples hereafter.

Thanks to the alternative BN provided by the di-alkylaminopolyalkylamines (I), preferably DMAPAPA, optionally in combination with overbased and neutral detergents, the cylinder lubricants according to the present invention are suitable both for high-sulphur fuel oils and for low-sulphur fuel oils.

Use for Lubricating Engines

The invention also relates to the use of a di-alkylaminopolyalkylamine (I) as defined above, preferably DMAPAPA, for lubricating engines, preferably marine engines.

The set of features, preferences and advantages disclosed for the lubricant composition according to the invention also apply to the above use.

Specifically, the invention is directed to the use of a di-alkylaminopolyalkylamine (I) as defined above, preferably DMAPAPA, for lubricating two-stroke marine engines and four-stroke marine engines, more preferably two-stroke marine engines.

In particular, the di-alkylaminopolyalkylamine (I) as defined above, preferably DMAPAPA, is suitable for use in a lubricant composition, as cylinder oil or system oil, for lubricating two-stroke marine engines and four-stroke marine engines, more preferably two-stroke marine engines.

The invention also relates to a method for lubricating two-stroke marine engines and four-stroke marine engines, more preferably two-stroke marine engines, said method comprising application to said marine engine of the marine lubricant as disclosed above. In particular, the lubricant is applied to the cylinder wall, typically by a pulse lubricating system or by spraying the lubricant onto the piston's rings pack through an injector for lubricating two-stroke engines.

Measurement of the performance differential between a conventional reference lubricant and a lubricant according to the invention:

This measurement is characterized by a neutralization effectiveness index measured according to the enthalpy test method precisely described in the examples and in which the progress of the exothermic neutralization reaction is monitored by the increase in temperature observed when the lubricant containing the basic sites is placed in the presence of sulphuric acid.

The present invention also concerns the use of the lubricant composition as above-defined as a cylinder lubricant able to be used with fuels having a content of sulphur inferior than 1% by weight, relative to the total weight of fuel, with fuels having a content of sulphur comprised between 1 and 3.5% by weight, relative to the total weight of fuel, or with fuels having a content of sulphur superior than 3.5% by weight, relative to the total weight of fuel.

The present invention also concerns a method for lubricating a marine engine, and more particularly a two-stroke marine engine, comprising operating the engine with a lubricant according to the invention.

The set of features, preferences and advantages disclosed for the lubricant composition according to the invention also apply to the above methods.

The percentages here-above defined correspond to weight percent of active material. It should be appreciated that the various aspects and embodiments of the detailed description as disclosed herein are illustrative of the specific ways to make and use the invention and do not limit the scope of invention when taken into consideration with the claims and the detailed description. It will also be appreciated that features from different aspects and embodiments of the invention may be combined with features from different aspects and embodiments of the invention.

EXPERIMENTAL

I—Material and Methods:

Amines:

The amine according to the invention is the dimethylaminopropylaminopropylamine (CAS 10563-29-8), available from Aldrich.

The comparative amine is the Tetrameen 2HT (CAS 1623405-26-4), available from Akzo Nobel/Nouryon.

Base Oils:

Base oil 1: Group I mineral oil called BSS viscosity at 40° C. of 500 cSt measured according to ASTM D7279.

Base oil 2: Group II mineral oil called 600R, viscosity at 40° C. of 104 cSt measured according to ASTM D7279.

Detergents:

Dtg1: calcium phenate of TBN=250 mg KOH/g according to ASTM D2896.

Dtg 2: calcium carboxylate of TBN=350 mg KOH/g according to ASTM D2896.

Additives:

An Anti-Foaming Agent (AF)

II—Preparation of the Lubricant Compositions:

The components listed in Table I are mixed at 60° C. The percentages disclosed in Table I correspond to weight percent with regards to the total weight of the composition.

TABLE I

| Composition | C1 (Invention) | C2 (Comparative) | C3 (Invention) | C4 (Comparative) |
|---|---|---|---|---|
| Base oil 1(BSS) | 18 | 18 | — | — |
| Base oil 2 (600R) | 53.49 | 49.66 | 98.33 | 94.5 |
| DMAPAPA | 1.67 | — | 1.67 | — |
| Comparative Amine: Tetrameen 2HT | — | 5.5 | | 5.5 |
| Dtg 1 | 5 | 5 | — | — |
| Dtg 2 | 21.8 | 21.8 | — | — |
| AF | 0.04 | 0.04 | — | — |
| TBN (Total base number in mg KOH/g of composition according to ASTM D2896) | 100 | 100 | 17.8 | 17.8 |

III—Performances of the Lubricant Compositions:

Test Method 1—Neutralization Kinetics:

This example describes the enthalpy test making it possible to measure the effectiveness of neutralization of the lubricants vis-à-vis sulphuric acid, which can be quantified by a dynamic monitoring of the kinetics or rate of the reaction.

Principle: acid-base neutralization reactions are generally exothermic and it is therefore possible to measure the generation of heat obtained by reacting sulphuric acid with the lubricants to be tested. This heat generation is monitored by temperature evolution over time in a DEWAR type adiabatic reactor. Starting from these measurements, it is possible to calculate an index quantifying the effectiveness of a lubricant with additives according to the present invention compared with a lubricant taken as reference.

This index is calculated with respect to the reference oil to which the value of 100 is given. This is the ratio between the neutralization reaction times of the reference (Sref) and of the measured sample (Smes):

$$\text{Neutralization effectiveness index} = Sref/Smes \times 100$$

The values of these neutralization reaction times, which are of the order of a few seconds, are determined from the acquisition curves of the temperature increase as a function of time during the neutralization reaction. The time period S is equal to the difference tf−ti between the time at the end-of-reaction temperature and the time at the start-of-reaction temperature. The time ti at the start-of-reaction temperature corresponds to the first temperature increase after stirring has been started. The time tf at the final temperature of the reaction is that starting from which the temperature signal remains stable for a period of time greater than or equal to half of the reaction time. The lubricant is thus even more effective in that it leads to short neutralization times and therefore to a high index.

Equipment used: The geometries of the reactor and the stirrer as well as the operating conditions were chosen so that they are situated in the chemical regime, where the effect of the diffusion constraints in the oil phase is negligible. Thus in the configuration of the equipment used, the height of fluid must be equal to the internal diameter of the reactor, and the stirrer screw must be positioned at approximately ⅓ of the height of the fluid. The apparatus is constituted by a cylindrical-type 250 ml adiabatic reactor, of which the internal diameter is 48 mm and the internal height 150 mm, with a stirring rod provided with a screw with inclined blades, 22 mm in diameter; the diameter of the blades is comprised between 0.3 and 0.5 times the diameter of the DEWAR, i.e. from 9.6 to 24 mm. The position of the screw is fixed at a distance of 15 mm from the bottom of the reactor. The stirring system is driven by a motor with a variable speed of 10 to 5000 r.p.m., and a system for acquiring the temperature as a function of time.

This system is suitable for measuring reaction times of the order of 5 to 20 seconds and for measuring a temperature increase of several tens of degrees starting from a temperature of approximately 20° C. to 35° C., preferably approximately 30° C. The position of the system for acquiring the temperature in the DEWAR is fixed. The stirring system is set such that the reaction takes place in the chemical regime: in the configuration of the present experiment, the speed of rotation is set at 2000 r.p.m, and the position of the system is fixed. Moreover, the chemical regime of the reaction is also dependent on the height of the oil introduced into the DEWAR, which must be equal to the diameter of the latter, and which corresponds, within the framework of this experiment, to a mass of 70 g of the lubricant tested.

3.5 g of 95% sulphuric acid concentrate and 70.0 g of lubricant (compositions C1, C2, C3 and C4) to be tested are introduced into the reactor. After placing the stirring system inside the reactor such that the acid and the lubricant are well mixed and in a manner which is repeatable over two tests, the acquisition system then the stirring are started in order to monitor the reaction. 3.5 g of acid is introduced into the reactor. Then 70.0 g of lubricant is introduced and heated to a temperature of approximately 30° C. The acquisition system is then started, then the stirring system is adjusted so as to be situated in the chemical regime.

Implementation of the Enthalpy Test—Calibration:

In order to calculate the effectiveness indices of the lubricants according to the present invention by the method described above, we have chosen to take as a reference the neutralization reaction time measured for a two-stroke marine engine cylinder oil of respectively BN 100 and BN 17.8 (measured by ASTM D-2896). Said oil respectively, either contains a calcium carboxylate of BN equal to 350 mg of KOH/g, an antifoaming agent, a calcium phenate of BN equal to 150 mg of KOH/g which are added to this base in a quantity necessary to obtain a lubricant of BN 84 mg of KOH/g (Total BN of 100), or either does not contain any detergent additive according to the present invention (Total BN of 17.8).

The oil (BN 100) is obtained from a mineral base (BSS group I and 600R group II), the amine Tetrameen 2HT, and a concentrate including a calcium carboxylate of BN equal to 350 mg of KOH/g, an antifoaming agent, a calcium phenate of BN equal to 150 mg of KOH/g is added to this base in a quantity necessary to obtain a lubricant of BN 100 mg of KOH/g. The neutralization reaction time of this oil (referred as C2) is around 31 seconds and its neutralization effectiveness index is fixed at 100.

Alternatively, the oil (BN 17.8) is obtained from a mineral base (600R group II) and no other additive than the amine Tetrameen 2HT was added. The neutralization reaction time of this oil (referred as C4) is around 20 seconds and its neutralization effectiveness index is fixed at 100.

Implementation of the Neutralization Effectiveness Test:

This example describes the influence of the additives according to the invention for a formulation at a constant BN of 100 mg KOH/g. The reference is the BN 100 mg KOH/g, without DMAPAPA according to the present invention, but with Tetrameen 2HT and referenced (C2) in the previous example.

The samples with additives BN 100 mg KOH/g tested have been prepared starting from the lubricant reference (C2) and replacing the Tetrameen 2HT with the DMAPAPA (C1). These samples are obtained by mixture in a beaker at a temperature of 60° C., under stirring which is sufficient to homogenize the mixture of the lubricant.

This example also describes the influence of the DMAPAPA according to the invention. The samples with additives BN 17.8 mg KOH/g tested have been prepared starting from the lubricant reference (C4) and replacing the Tetrameen 2HT with the DMAPAPA (C3) for a formulation at a constant BN of 17.8 mg KOH/g.

These samples are obtained by mixture in a beaker at a temperature of 60° C., under stirring which is sufficient to homogenize the mixture of the lubricant.

Table II below shows the values for the effectiveness indices of the various samples prepared in this way.

TABLE II

| | BN (mg KOH/g) | Neutralization effectiveness index |
|---|---|---|
| C1 | 100 | 202 |
| C2 | 100 | 100 |
| C3 | 17.8 | 139 |
| C4 | 17.8 | 100 |

The invention claimed is:

1. Lubricant composition comprising:

at least one lubricant base oil, at least one di-alkylaminopolyalkylamine responding to formula (I):

(I)

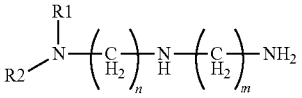

wherein,

R1, R2 represent, independently, an alkyl moiety with 1 to 3 carbon atoms, which is linear or branched, n and m are integers representing, independent of each other either 1, 2, or 3, and the total number of carbon atoms in formula (I) is from 4 to 10.

2. The lubricant composition according to claim 1, wherein in formula (I), R1=R2=$CH_3$.

3. The lubricant composition according to claim 1, wherein the di-alkylaminopolyalkylamine (I) responds to formula (IA):

(IA)

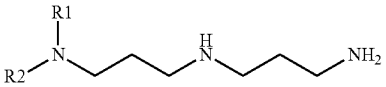

wherein R1, R2 represent, independently, an alkyl moiety with 1 or 2 carbon atoms.

4. The lubricant composition according to claim 1, wherein the di-alkylaminopolyalkylamine responding to formula (I) is dimethylaminopropylaminopropylamine (DMAPAPA):

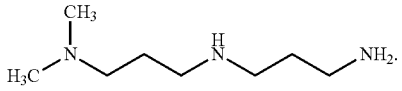

5. The lubricant composition according to claim 1, wherein the percentage by weight of di-alkylaminopolyalkylamine of formula (I), relative to the total weight of lubricant composition is chosen such that the BN provided by the di-alkylaminopolyalkylamine of formula (I) represents a contribution of at least 0.1 milligrams of potash per gram of lubricant, relative to the total BN of said lubricant.

6. The lubricant composition according to claim 1, wherein the percentage by weight of di-alkylaminopolyalkylamine of formula (I), relative to the total weight of the lubricant composition ranges from 0.05 to 10%.

7. The lubricant composition according to claim 1, wherein it comprises:

from 90.00 to 99.95% of at least one base oil, from 0.05 to 10.00% of at least one di-alkylaminopolyalkylamine of formula (I), the percentages being defined by weight of component as compared to the total weight of the composition.

8. The lubricant composition according to claim 1, wherein it comprises at least one detergent (Det) selected from neutral and overbased detergents having a Total Base Number according to ASTM D2896 of from 20 to 500 mg KOH/g.

9. The lubricant composition of claim 8, wherein it comprises from 1 to 35% weight of neutral and overbased detergents, with regards to the total weight of the lubricant composition.

10. The lubricant composition of claim 9, wherein it comprises:

from 60.0 to 98.5% of at least one base oil, from 0.5 to 5.0% of at least one amine of formula (I), from 1.0 to 35.0% of at least one detergent selected from neutral and overbased detergents having a Total Base Number according to ASTM D2896 of from 20 to 500 mg KOH/g the percentages being defined by weight of component as compared to the total weight of the composition.

11. The lubricant composition according to claim 1, which has a Total Base Number (TBN) value according to ASTM D2896 of above 10 mg KOH/g.

12. The lubricant composition according to claim 1, which has a kinematic viscosity at 100° C. superior or equal to 5.6 $mm^2/s$ and inferior or equal to 26.1 $mm^2/s$.

13. A method for lubricating a marine engine, comprising operating the engine with the lubricant composition according to claim 1.

14. The method for lubricating a marine engine according to claim 13, wherein the marine engine is a two stroke marine engine.

15. The method for lubricating a marine engine according to claim 13, wherein the lubricant composition is applied to a cylinder wall of the marine engine.

16. The method for lubricating a marine engine according to claim 15, wherein the lubricant composition is applied to the cylinder wall of the marine engine by a pulse lubricating system or by spraying the lubricant composition onto a piston's rings pack through an injector.

* * * * *